US006499411B2

(12) United States Patent
Brown

(10) Patent No.: US 6,499,411 B2
(45) Date of Patent: Dec. 31, 2002

(54) TABLE TENT

(76) Inventor: Phillip Charles Brown, 1327 Mosher La., Houston, TX (US) 77088

( * ) Notice: Subject to any disclaimer, the term of this patent is extended or adjusted under 35 U.S.C. 154(b) by 0 days.

(21) Appl. No.: 09/826,860

(22) Filed: Apr. 6, 2001

(65) Prior Publication Data

US 2002/0144633 A1 Oct. 10, 2002

(51) Int. Cl.[7] ..... A47B 13/08
(52) U.S. Cl. ..... 108/90; 108/26
(58) Field of Search ..... 108/90, 91, 92, 108/24, 26, 25, 26.2; 135/96; 150/158

(56) References Cited

U.S. PATENT DOCUMENTS 1,240,208 A * 9/1917 Holtmeyer
2,341,672 A * 2/1944 Terrill
2,556,943 A * 6/1951 Reisman
4,821,651 A * 4/1989 Peng
4,841,878 A * 6/1989 Kriegsman
5,311,813 A * 5/1994 Fairbanks et al.
5,697,305 A * 12/1997 Chasan et al.
5,727,477 A * 3/1998 Kirkendall

FOREIGN PATENT DOCUMENTS

GB 310279 * 4/1929

* cited by examiner

*Primary Examiner*—Jose V. Chen
(74) *Attorney, Agent, or Firm*—Donald C. Casey, Esq.

(57) ABSTRACT

A table tent is described for protecting food at an outdoor picnic. The table tent is intended to be constructed of mesh and supported on an interframe covering a conventional picnic table top. A mesh panel is provided immediately adjacent a table top and typically a plastic bottom which would have drain holes therein is provided on top of the mesh. The supporting frame rests on top of the plastic bottom and a mesh tent is provided having a roof resting on the top of the supporting frame and depending sides. The sides would be affixed to the border of the mesh base panel preferably by Velcro strips. Access to the table tent is provided by clear plastic windows in the upper roof which are secured by Velcro strips to the mesh tent. Compartments are further provided in the structure covered by clear plastic windows for holding eating utensils, napkins, bread and the like.

10 Claims, 2 Drawing Sheets

TABLE TENT

FIELD OF THE INVENTION

This invention relates to a picnic table cover designed to protect both the table top and food located thereon from air blown dust, insects, and debris.

DESCRIPTION OF THE PRIOR

Protective covers for picnic tables designed to protect the table top itself are well known in the art. For example, in U.S. Pat. No. 3,270,515, there is described a cover of plastic material which is secured to the surface of the table top and picnic table seats by transverse straps which extend across the bottom of the table. Similarly, U.S. Pat. Nos. 3,295,577, 4,705,084, and 4,883,001 describe other types of table top covers which are designed to be substituted for a conventional table cloth and which are generally impervious to moisture so that after meal clean-up is facilitated. Also, U.S. Pat. No. 5,727,477 describes a rigid or semi-rigid covering for a table which is a sandwich construction of plastic laminate or foam and plywood, which is intended to rest on the table top and provide skirt members which hand downwardly from the sides and ends of the table top.

Various means of securing these prior art table top covers are described, including straps, Velcro strips, drawstrings, snaps, and the like.

None of the aforementioned devices are intended to protect food items, displayed on the table top, from insects and wind blown debris. These devices are intended to protect the table top itself.

It is also known in the prior art to provide tent like structures which surround a picnic table and are generally intended to accommodate people eating at a picnic table. The tent like structures are mesh screening or the like and are supported by a framework affixed to the table top. See for example U.S. Pat. Nos. 3,233,618, 2,790,452, and 3,307,565.

These tent like structures are cumbersome and intended to accommodate only those individuals actually sitting at the supporting picnic table. Such structures would have difficulty accommodating a buffet type picnic where people consuming the food would approach the table, fill their plates with food, and then leave the tent to eat elsewhere.

U.S. Pat. No. 2,341,672 describes a screen mounted on a table top wherein the roof of the screen is based above the table top so that items could be accommodated on the table top inside the screen. The sides of the screen depend from the table top and are weighted and presumably would be lifted by someone accessing the food displayed on the table. This device uses a supporting framework with a net draped thereover. Since the screen is merely draped over the framework insects would be free to enter the enclosure under the depending skirt of the screen, and while the supporting frame is secured to the picnic table top, the screen itself is only secured to the supporting frame at the comer posts.

It is also known to provide an individual tent member for a cutting board and such a device is described in U.S. Pat. No. 5,311,813. In that device, a supporting frame is provided for a mesh tent which encloses a cutting board and presumably food items. Access to the interior of the tent like cover is provided by a port which is made be secured to the grounding net by Velcro, snaps, or a zipper. This device is intended to protect only a relatively small cutting board as its supporting framework is described as a truss structure which consists of a plurality of arcuate shaped legs of flexible material which are joined at an apex to form the supporting structure for the tent. This patent also describes a separate waterproof covering which may rest over the mesh tent to protect the interior from rain or the like.

Accordingly, there is a need for a universally adaptable protective tent like structure for a picnic table which will protect displayed food items and provide access so that individuals can, in buffet fashion, fill their plates and move on. There is also a need for such a device that is portable, light weight, and durable.

SUMMARY OF THE INVENTION

It has been discovered that such a light weight and durable table tent can be provided that will protect food items that are displayed on a picnic table while providing access to those items so that individuals can fill their plates and then close the access opening to protect the unused food items from insects, dust, and other wind blown debris. The table tent of this invention is preferably supported by an aluminum pole framework wherein aluminum poles similar to hollow tent poles are used and interconnected by press fitting in the conventional fashion to form four, three dimensional interconnected boxes. The supporting structure preferably has rectangular vertical and horizontal cross-sections. A tent like mesh covering is provided which overlies the supporting box like framework on the top and sides. A mesh base is provided and preferably a plastic bottom guard with drain holes overlies the net or mesh base. The net or mesh base is interconnected to the edges of the depending sides of the overlying tent by conventional fasteners such as Velcro. The top surface of the tent is provided with preferably three large clear plastic windows secured by Velcro to the surrounding mesh so that each window can be opened for access to the interior of the tent structure. Also preferably a pair of clear plastic compartments are provided for storing utensils, napkins, bread, and the like.

Accordingly, it is an object of this invention to provide a portable mesh tent like structure adapted to rest on the surface of a picnic table for enclosing food items displayed on the picnic table and provide access to such items.

It is another object of this invention to provide a table tent structure for displaying items on the picnic wherein an internal supporting structure of interconnected hollow poles is provided and an overlying mesh structure supported by the poles protects food items enclosed therein from insects, dust, and wind blown debris.

It is yet another object of this invention to provide a table tent structure adapted to rest on a conventional picnic table wherein food items displayed within the structure are fully enclosed within a see-through tent and access is provided through clear plastic windows, mutually spaced along the roof of the tent.

It is yet another object of this invention to provide a portable structure wherein a framework can be assembled from interconnected poles to define a box having a horizontal base and roof thereover with interconnected vertical sides wherein food items displayed within the tent are fully enclosed by a protective mesh with access windows provided in the roof of the tent.

These and other objects will become readily apparent with reference to the drawings and following description wherein:

DETAILED DESCRIPTION OF THE INVENTION

Figure 1:
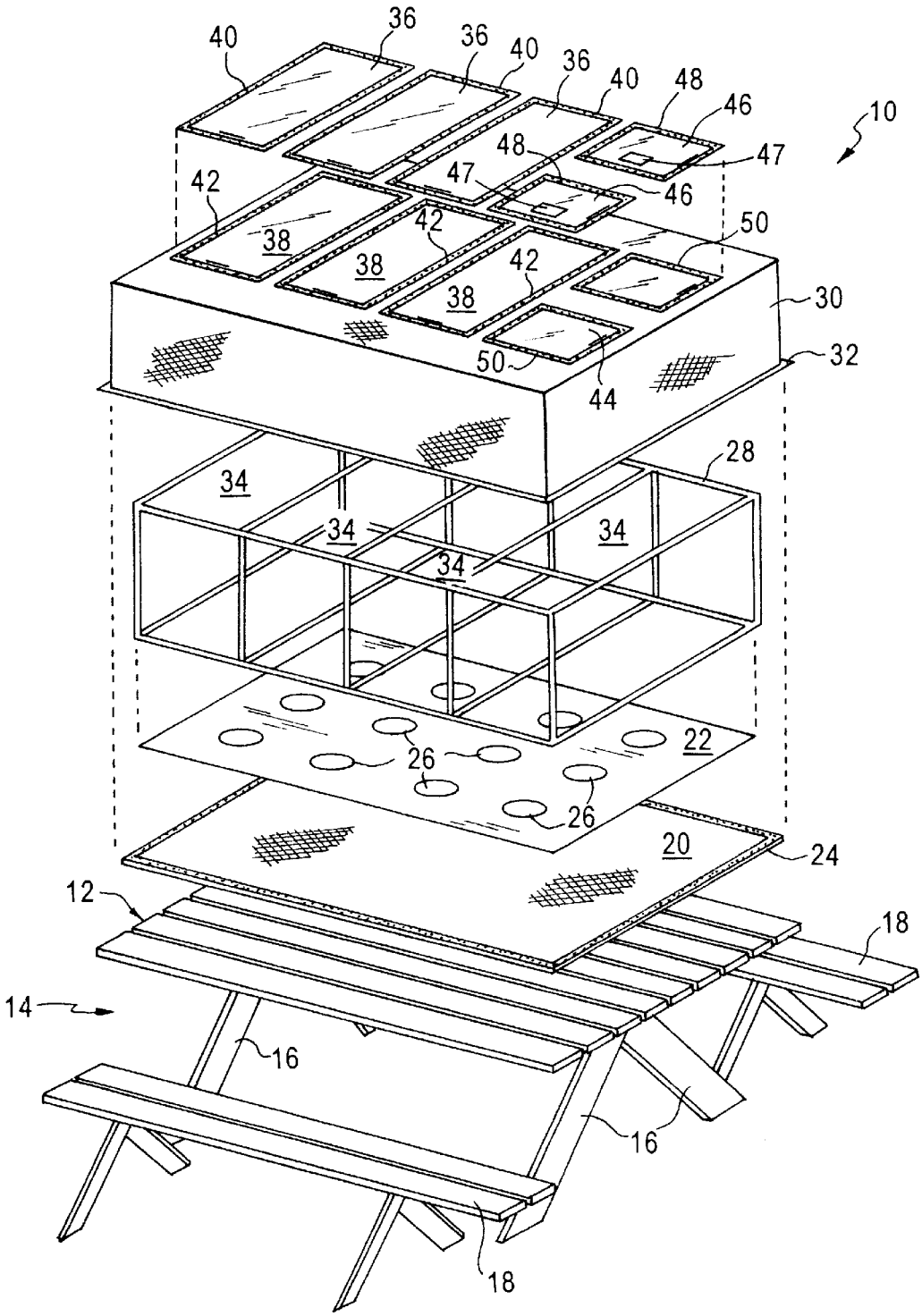
FIG. 1 is an exploded view of the table tent of this invention with a conventional picnic table.

With attention to the figures the table tent 10 of this invention is intended to rest on the table top 12 of a conventional picnic table 14 in which the top 12 is supported by legs 16 and there are benches 18 provided. Benches 18, need not be present and could be removed if the table 14 is used as a buffet.

With attention to FIG. 1, the table top 10 includes a mesh panel 20 intended to overlay the table top 12. A plastic sheet bottom 22 is dimensioned to rest within the border 24 of panel 20. Vent holes 26 are provided in the plastic bottom 22 so that any liquids spilled on the bottom 22 can drain through the mesh 20 and the table top 12.

Figure 2:
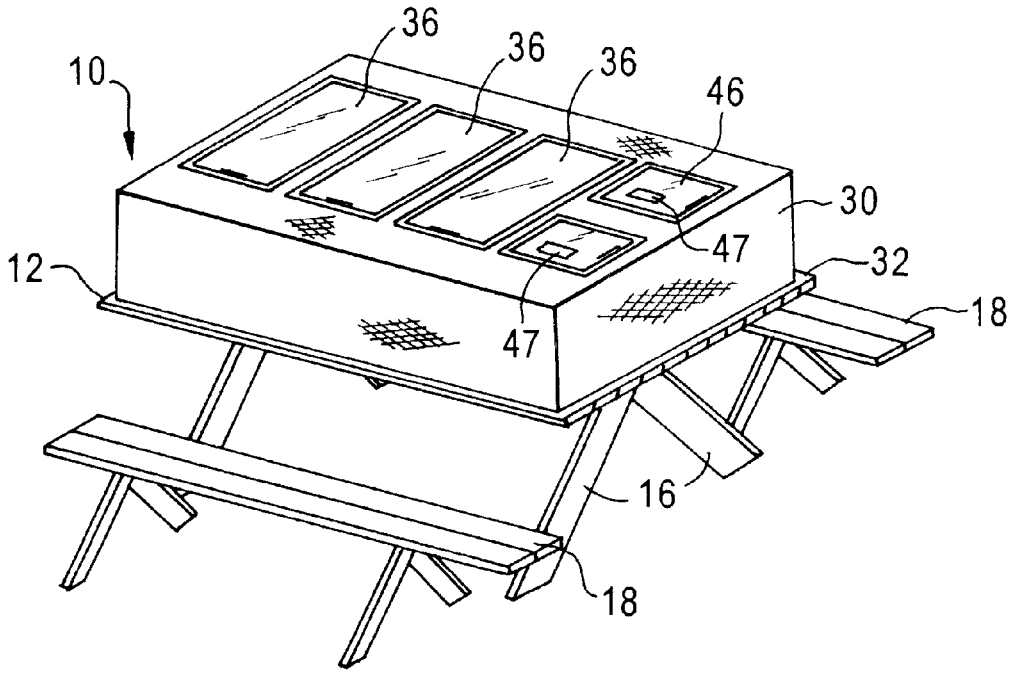
FIG. 2 is a perspective view of the assembled table tent of this invention resting on a conventional picnic table.

A supporting frame 28 rests on the plastic bottom 22 and is used to support the upper mesh covering 30. A border 32 is provided integrally with mesh 30 and is dimensioned to rest on border 24 of lower panel 20. In the preferred embodiment borders 32 and 24 would mount Velcro strips so that when the table tent 10 is assembled in the position of FIG. 2 the borders would secure upper mesh 30 to lower panel 20. In this way insects would not be able to gain access to the interior of table tent 10.

In the preferred embodiment, the supporting structure 28 consists of interlocking hollow aluminum tubes which interlock in a conventional fashion. For example, each juncture where horizontal and vertical supports meet could be a conventional web-type, female connector having either three or four sockets for receiving ends of tubes which could merely be press fitted thereinto.

While this invention is not intended to be limited to the method for connecting the support structure 28 it will be obvious to one skilled in the art that the support structure could be a unitary piece or could be broken down into the individual horizontal and vertical tube members with connectors at the junctures.

The support structure however consists of four integral box supports with common sides of vertical and horizontal tubular support members. The overall structure 28 is dimensioned to fit within the borders 24 and 32 so that the upper mesh member 30 is draped over the support 28.

Three clear plastic windows 36 are mounted on holes 38 in the upper surface of mesh member 30 typically, in the preferred embodiment, by Velcro border strips 40 and 42 so that access to the interior of the table tent 10 can be provided by merely lifting one or more of the windows 36 to separate windows 36 and mesh members 30. Each window 36 is intended to be received over one of the integral box members 34. In addition, compartments 44 are also provided in member 30 which are covered by clear plastic windows 46 and typically secured by zippers or Velcro strips at borders 48 and 50. Handles 47 may be provided on windows 46. The compartments 44 are intended to contain eating utensils, bread, and the like.

The table tent structure of this invention then is basically a mesh enclosure which preferably has a height of about fourteen inches and length and width sufficient to be supported on a conventional picnic table top.

Access to the interior of table tent 10 is provided through clear plastic windows 36 which are secured to the table tent by Velcro strips 40 so that when it is desired to have access to food enclosed within the table tent 10 a window 36 is manually separated from the Velcro border 42 and when the food is removed, the window 36 is merely replaced in the conventional fashion.

Because of the bulk of the table tent 10, it is not normally necessary to affix table tent 10 to the picnic table top 12. The open mesh construction is intended to permit normal ventilation and the overall design is intended to facilitate a picnic type atmosphere while protecting the food from insects, debris and the like.

It will be readily seen by one of ordinary skill in the art that the present invention fulfills all of the objects set forth above. After reading the foregoing specification, one of ordinary skill will be able to effect various changes, substitutions or equivalents and various other aspects of the invention as broadly disclosed herein. It is therefore intended that the protection granted hereon be limited only by the definition contained in the appended claims and equivalents thereof.

I claim:

1. A tent structure for protecting food displayed on a picnic table having a table top supported by legs comprising:

a floor for said structure including a rectangular net panel adapted to over lie at least a portion of a table top, a rectangular box shaped supporting structure dimensioned to rest on said floor and having four sides, a roof and a base, said supporting structure comprising a plurality of mutually spaced horizontal and vertical interlocking members;

a mesh cover panel for said supporting structure covering the sides and roof thereof;

first connecting means carried by said floor panel and cover panel for releasably connecting the periphery of said floor panel and the sides of said cover panel, a plurality of clear plastic windows formed in the portion of said cover overlying the roof of said structure and means for selectively opening and closing said windows for access to the interior of said structure.

2. The structure of claim 1 further comprising at least one clear, waterproof pouch formed in the portion of said cover overlying the roof for receiving and displaying pre-selected articles.

3. The structure of claim 1 wherein said box-shaped structure comprises four interconnected rectangular boxes having vertical and horizontal support members at the edges thereof.

4. The structure of claim 3 wherein a window is formed in the cover overlying the roof portion of at least one of said rectangular boxes.

5. The structure of claim 4 wherein a window is formed in the cover over each of three of said four boxes.

6. The structure of claim 4 wherein at least one pouch is formed in said cover in one of said boxes.

7. The structure of claim 6 wherein two of said pouches are provided.

8. The tent structure of claim 1 wherein said floor further comprises a plastic sheet having a plurality of drain holes therethrough overlying said mesh panel and disposed below said supporting structure.

9. The structure of claim 1 wherein window receiving ports are provided in said overlying cover and second connecting means for releasably connecting the periphery of said windows and said overlying cover.

10. The structure of claim 1 wherein said interlocking supporting structural member are tubular.

* * * * *